United States Patent [19]

Shimazaki

[11] Patent Number: 4,847,629

[45] Date of Patent: Jul. 11, 1989

[54] RETRACTABLE CELLULAR ANTENNA

[75] Inventor: Tetsuo Shimazaki, Tokyo, Japan

[73] Assignee: Alliance Research Corporation, Chatsworth, Calif.

[21] Appl. No.: 227,889

[22] Filed: Aug. 3, 1988

[51] Int. Cl.[4] ..... H01Q 1/10; H01Q 1/32

[52] U.S. Cl. ..... 343/901; 343/715

[58] Field of Search ..... 343/713, 714, 715, 745, 343/749, 822, 860, 864, 900, 901, 903

[56] References Cited

U.S. PATENT DOCUMENTS

| | | | |
|---|---|---|---|
| 3,513,472 | 5/1970 | Altmayer | 343/861 |
| 4,095,229 | 6/1978 | Elliott | 343/715 |
| 4,280,129 | 7/1981 | Wells | 343/715 |
| 4,675,687 | 6/1987 | Elliott | 343/715 |
| 4,721,965 | 1/1988 | Elliott | 343/715 |
| 4,725,846 | 2/1988 | Hendershot | 343/715 |
| 4,734,703 | 3/1988 | Nakase et al. | 343/715 |
| 4,764,773 | 8/1988 | Larsen et al. | 343/713 |

FOREIGN PATENT DOCUMENTS 0245805 10/1987 Japan .

*Primary Examiner*—Rolf Hille
*Assistant Examiner*—Doris J. Johnson
*Attorney, Agent, or Firm*—Marvin H. Kleinberg; Matthew F. Jodziewicz

[57] ABSTRACT

An antenna assembly for use on a vehicle includes telescoping radiating sections that collapse toward an insulated mounting base, so that the radiating sections can be selectively extended. An impedance matching network with concentric outer and inner conductive tubular members slidably receives the telescopically collapsed radiating sections. Both tubular members are attached to the mounting base and electrically insulated therefrom and from each other. The inner tubular member is electrically connected to the radiating sections at a base end thereof. The outer tubular member has at least one longitudinal slot therein through which the central conductor of a transmission line is connected to the inner member. A ground contact is electrically connected to the outer tubular member. A slidable terminal that is selectively adjustable longitudinally along the outer tubular member is connected to the transmission line to select a signal insertion point.

27 Claims, 2 Drawing Sheets

RETRACTABLE CELLULAR ANTENNA

BACKGROUND OF THE INVENTION

1. Field of the Invention

This invention relates in general to mobile communications antennas, and, more particularly, to a retractable mobile communications antenna suitable for cellular telephone and standard AM or FM radio reception.

2. Description of the Related Art

Cellular telephones require an antenna for both transmission and reception of high frequency radio signals, usually in the range of 825 to 895 MHz.

With the proliferation of cellular telephones in mobile vehicles, cellular, or car phone antennas have become both a common sight and one easily recognizable by the casual observer as a short, approximately eight inches, radiating whip antenna.

Unfortunately, the criminal element has also recognized the cellular antenna as a signal that an expensive cellular telephone is to be found in the vehicle. An exploding theft rate for vehicles sporting the tell-tale cellular antenna is therefore not unexpected.

Since cellular telephone users are generally only consumers of a service and know little about the operation of the cellular system, their primary desire is that the cellular telephone system in their vehicles function flawlessly, and that it do so as inconspicuously as possible.

Accordingly, dedicated, readily noticeable cellular antennas have fallen out of favor, not only because of increasing theft insurance premiums, but also because they can mar the appearance of an otherwise fine exterior design of a modern vehicle.

In many vehicles, the AM-FM radio is connected to an antenna that can be extended and retracted automatically, whenever the radio is activated. Normally, when the vehicle is parked and unattended, the antenna is retracted and unnoticed. Accordingly, the answer to some of these concerns appears to be the retractable antenna assembly, the use of which completely conceals the fact that the vehicle has a cellular telephone.

Several attempts have been made to create a telescopic antenna assembly for the mobile cellular frequency range, but all have generally failed for a number of reasons.

U.S. Pat. No. 4,725,846 is representative of the prior art in retractable cellular mobile antennas for vehicles. In this patent, the cellular mobile antenna is merely disguised as a conventional antenna, but fails to address the problems created by the retractable nature of the cellular portion of the antenna with regards to feed point efficiency and changing installation conditions. Chief among these problems is the difficulty in the matching impedance in a retractable antenna between the transmission line and the antenna due to the movement of the antenna feed point. That is, the point where the balanced coaxial cable connects to the base of the antenna radiating element to transfer the signal between the cellular telephone transceiver and the antenna system.

Likewise, there has been considerable difficulty in providing an antenna assembly that has a sufficiently broadband response over the entire 70 MHz alloted to the cellular mobile service (824 to 894 Mhz).

The present invention solves these problems by providing an antenna suitable for broadband mobile communication in the cellular range that is both retractable when not in use and which resembles an ordinary AM or FM vehicle antenna. In fact, embodiments of the present invention can be used for both cellular communications and standard AM - FM broadcast band reception.

SUMMARY OF THE INVENTION

One object of the present invention is to provide an antenna assembly that is substantially indistinguishable from a conventional vehicular AM-FM antenna, but which is effective as a cellular telephone antenna for operation at frequencies in the cellular telephone range of 800 to 900 MHz.

Another objective of the present invention is to provide an antenna assembly which serves as an antenna for a cellular telephone operating in the alloted cellular frequencies of 800 to 900 MHz, and that simultaneously serves as a conventional vehicular AM-FM antenna, which for all intents and purposes, resembles the physical appearance a conventional antenna.

Still another objective of the present invention is to provide an antenna assembly which is telescopically extendible for use and retractable when not in use.

In accordance with the present invention, these objectives are achieved by using an antenna having telescoping radiating sections that collapse toward an insulated mounting base, so that the radiating sections can be selectively extended or collapsed. An impedance matching network, having concentric outer and inner conductive tubular members, slidably receives the telescopically collapsed radiating sections. Both tubular members are attached to the mounting base and are held spaced from one another in a fixed, electrically insulated relation. The inner tubular member is electrically connected to the antenna at a base end thereof, and the outer tubular member has at least one longitudinal slot therein. A connector connects a transmission line to an impedance matching network and comprises an electrical conductor having a main electrical contact and a ground contact. The main electrical contact is electrically connected to the inner tubular member through the longitudinal slot in the outer tubular member, and the ground contact is electrically connected to the outer tubular member. The electrical conductor is selectively adjustable along the longitudinal length of the outer tubular member to provide a means to "fine tune" the impedance characteristics of the antenna assembly to meet the specific conditions of the vehicle on which it is mounted.

The novel features of construction and operation of the invention will be more clearly apparent during the course of the following description, reference being had to the accompanying drawings wherein has been illustrated a preferred form of the device of the invention and wherein like characters of reference designate like parts throughout the drawings.

DESCRIPTION OF THE PREFERRED EMBODIMENTS

Figure 1:
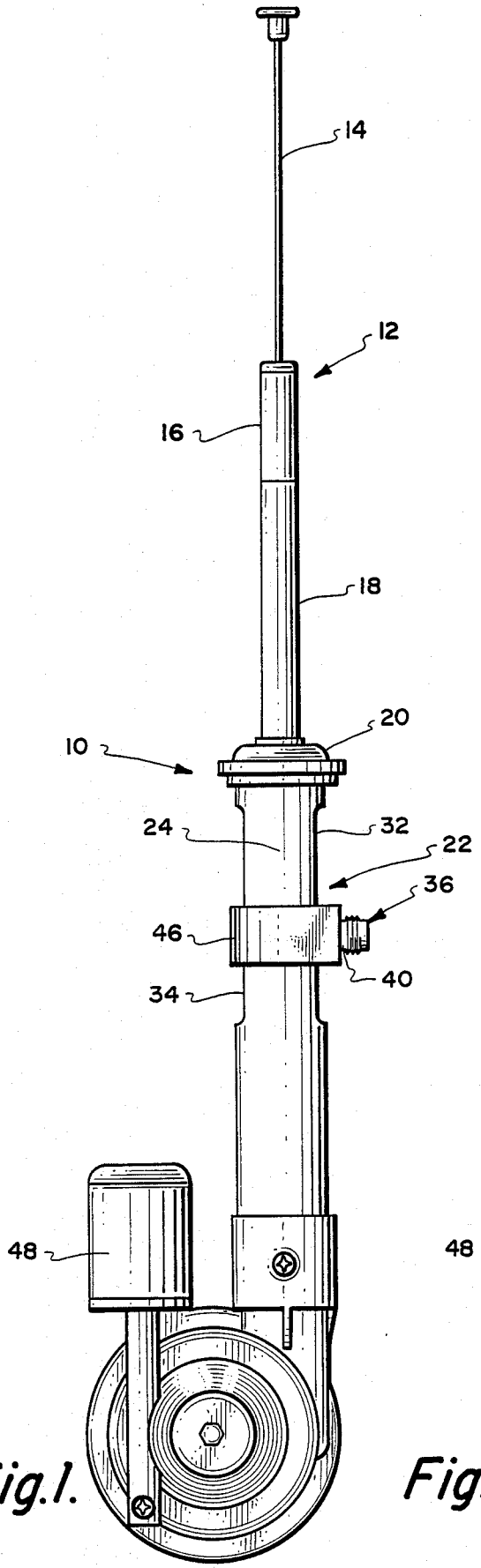
FIG. 1 is a side elevation view of a preferred retractable cellular antenna embodying the present invention.
Figure 2:
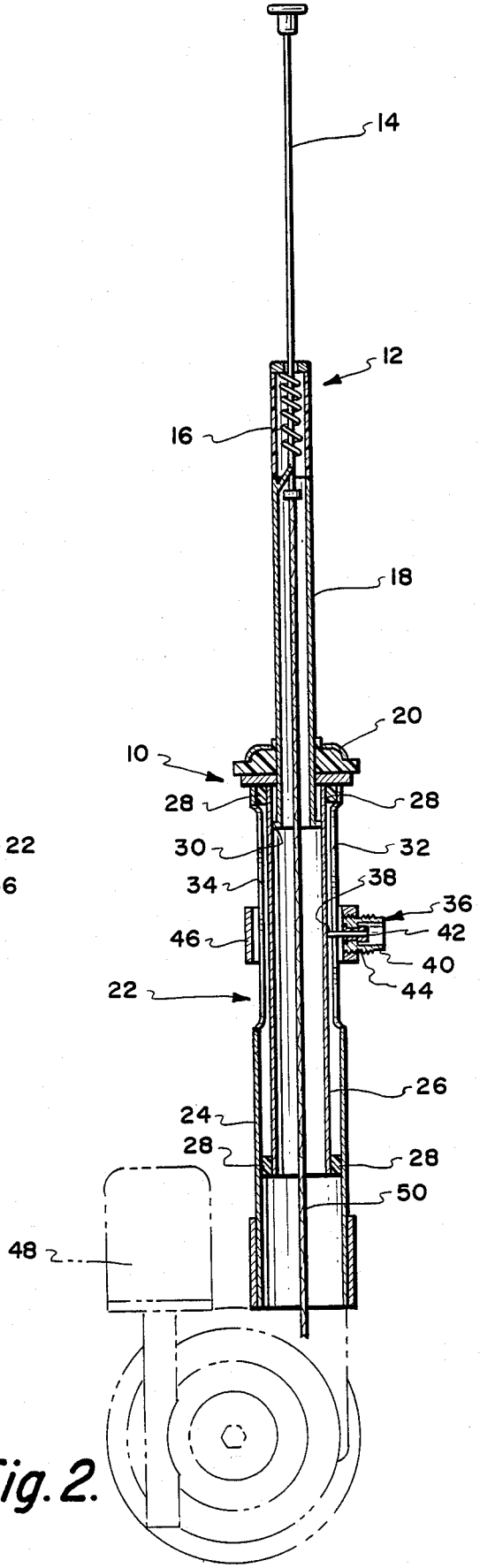
FIG. 2 is a fractional cross-sectional side view of the antenna of FIG. 1.

A preferred retractable antenna assembly that can be mounted on a vehicle and is suitable for use on the mobile cellular band as well as for reception of conventional AM-FM radio programs is shown in FIGS. 1 and 2.

The antenna assembly 10, includes a radiating antenna portion 12.

Radiating portion 12 of antenna assembly 10 is preferably a Franklin, or collinear array type antenna system having a first elongated, substantially five-eighths wavelength radiating section 14, electrically connected through a phasing coil 16 to a second collinear, tubular elongated, substantially half wavelength radiating section 18. Both the first and second radiating sections 14 and 18, are in telescoping relation to one another and to an insulated mounting base 20, so that they can be selectively telescoped to an extended position for transmitting or receiving signals and telescopically collapsed toward mounting base 20 to a closed position when the antenna is not in use.

While several attempts have been made to create telescopic antennas for the mobile cellular band, there have been many problems due to the difficulty of matching transmission line impedance with an antenna assembly having a moving feed point, that is, where the balanced coaxial cable transmission line connecting the transceiver unit connects to the radiating section of the antenna.

In order to solve the feed point mobility problem and its consequent variable impedance matching problem, the present invention provides an impedance matching network 22 that includes a balun, or matching circuit, having concentric outer and inner conductive tubular members 24 and 26 respectively, with sufficient length and inner diameter to slidably receive therein the telescopically collapsed first and second radiating sections 14, 18 of antenna 12.

Both tubular members 24, 26 are attached to mounting base 20, and are held spaced from one another in a fixed, electrically insulated relation. Insulators 28 may be placed between the two tubes 24, 26 to insure that tubes 24, 26 remain spaced apart and axially aligned.

Inner tubular member 26 is electrically connected to antenna 12 at a base end 30, and electrically isolated from the outer, larger tubular member 24. As suggested in FIG. 2, inner tubular member 26 preferably has an inner diameter chosen to maintain a sliding contact with the second, or lower, radiating section 18 of antenna 12. In this manner, antenna sections 14 and 18 are free to be telescopically extended or collapsed and still maintain electrical contact with the inner tubular member 26 of impedance matching network 22.

Inner tubular member 26 preferably has a length approximately that of one-quarter wavelength for the desired frequency band. As such, it approximates a quarter wave matching stub or a quarter wave sleeve-type balun.

Outer tubular member 24 has two aligned longitudinal slots 32, 34 therein on opposite sides of its tube wall. While only two slots 32, 34 are shown in the drawings, there may be any such number of apertures cut in the outer tubular member 24 of impedance matching network 22. In fact, the position, extent and number of slots placed in outer tubular member 24 is a function of a number of variables, such as tube length, thickness, and spacing between the two tubular members 24, 26 of impedance matching network 22.

Impedance matching network 22 preferably displays an impedance which varies between a first impedance at the connection to the antenna base end 30 which is substantially equal to the impedance of the antenna base end, and a second impedance at least several orders of magnitude less than the first impedance.

Figure 4:
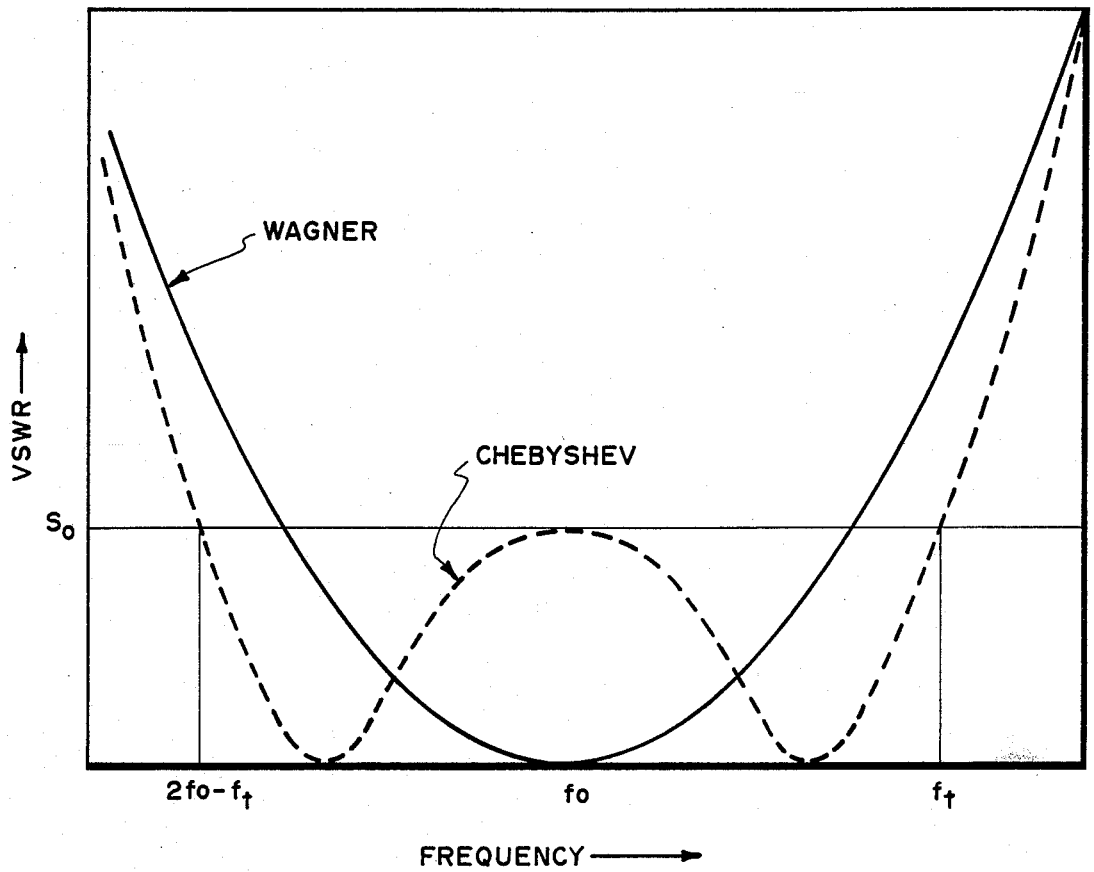
FIG. 4 is a graph showing the Wagner curve and Chebyshev effects as applied to a desired frequency bandwidth.

With this arrangement of two impedance values for the impedance matching network, the invention is able to create an effect known as the Chebyshev effect where two low Voltage Standing Wave Ratio (VSWR) points are created over the bandwidth of the antenna, best shown in FIG. 4.

Figure 3:
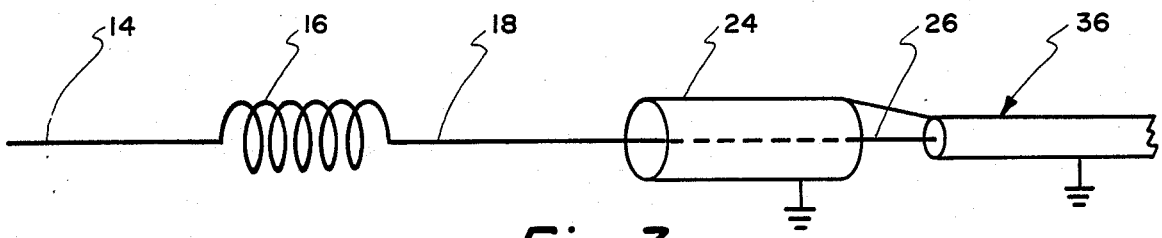
FIG. 3 is a schematic diagram of the antenna assembly of FIGS. 1 and 2.

Specifically, since mobile cellular equipment operates at two sets of frequencies (824 to 849 MHz for transmitting and 869 to 894 MHz for receiving), causing a Chebyshev effect within the bandwidth of the antenna will reduce the VSWR at the two essential sub-bands within the mobile cellular band, resulting in a lower overall effective VSWR for the entire bandwidth than were a straight Wagner type VSWR curve to be created centered in the mobile cellular band. The apertures in the outer tubular member of the impedance matching network aid to create the desired Chebyshev effect within the desired bandwidth, and, by slight variation in position, number or shape, best determined by trial and error methods, the Chebyshev low VSWR points within the desired band can be maximized for any one particular installation as best shown in FIG. 3.

This impedance matching network 22 will deliver a higher impedance to the radiating antenna sections 14 and 18, than to the transmission line (which normally must be in the range of 50 ohms). The higher the impedance at the antenna base feed point, the more pronounced the Chebyshev effect will be.

A coaxial connector 36 connects a transmission line (not shown for purposes of simplicity in the drawings) to impedance matching network 22 at a point 38 where the impedance of the impedance matching network is substantially equal to the impedance of the transmission line. Coaxial connector 36 has an electrical conductor 40 with a main electrical contact 42 and a ground contact 44. Main electrical contact 42 is electrically connected to the inner tubular member 26 through one of the longitudinal slots 32 in the outer tubular member 24. Ground contact 44 is electrically connected to outer tubular member 24 through a slidable band 46 that surrounds the outer diameter of outer tubular member 24. By mounting the coaxial connector 36 on a slidable band 46, the electrical conductor 40 is selectively adjustable along the longitudinal length of outer tubular member 24 providing a means by which the feed point 38 and impedance values of the impedance matching network 22 may be varied to achieve optimum performance for any one installation.

While not shown for purposes of clarity in the drawings, a transmission line normally attached to the coaxial connector 36, connects the antenna assembly 10 and a radio communications unit.

Transmission lines generally have an impedance orders of magnitude less than the impedance at the base end of the antenna, thus necessitating an impedance matching network as described above.

In general, the impedance of the impedance matching network at the transmission line connection is in the range of approximately 50 ohms to match the impedance of the transmission line, and the impedance at the base end of the antenna is in excess of 50 ohms and may be in the range of 100 to 100,000 ohms or so.

Shown in the drawings, in general form, is an electrical motor 48 and a flexible cable 50, well known in the retractable antenna art, that are operatively connected to the radiating portions 14, 18 of antenna 12 to selectively extend or collapse the telescoping radiating sections 14, 18 of antenna 12. Electrical motor 48 is selectively controllable by a user. In alternative embodiments, electrical motor 48 may be automatically controlled by the activation of a vehicle radio or by other cellular equipment connected to antenna assembly 10.

The present invention may be combined with a conventional radio receiver for the AM and FM bands as well as mobile cellular transceiver equipment by using appropriate switching and band filtering circuitry. In this manner the same antenna can be used for both cellular communication and, when not in such use, for the reception of standard radio broadcasts, thus eliminating the need for a second antenna on the vehicle.

The invention described above is, of course, susceptible to many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

What is claimed is:

1. An antenna assembly for use on a vehicle, comprising:

a first elongated, substantially five-eighths wavelength radiating section;

a second, collinear, tubular elongated, substantially half wavelength radiating section electrically connected through a phasing coil to said first radiating section, said first and second radiating sections being in telescoping relation to one another;

an insulated mounting base containing said first and second radiating sections telescopically mounted therein, said first and second radiating sections capable of being selectively telescoped to an extended position for transmitting or receiving signals and collapsed toward said base to a closed position when the antenna is not in use;

impedance matching means including capacitively coupled concentric outer and inner conductive tubular members, each with sufficient length and inner diameter to slidably receive therein said telescopically collapsed first and second radiating sections, both of said tubular members being attached to said mounting base and held spaced from one another in a fixed, electrically insulated relation, said inner tubular member electrically connected to the antenna at a base end thereof, and said outer tubular member having two aligned longitudinal slots therein on opposite sides of said outer tubular member, said impedance matching means displaying an impedance which varies between a first impedance at said connection to the antenna base end which is substantially equal to the impedance of the antenna base end, and a second impedance at least several orders of magnitude less than said first impedance;

coupling means adapted to connect transmission line means to said impedance matching means at a point where the impedance of said impedance matching means is substantially equal to the impedance of the transmission line means, said coupling means comprising an electrical conductor having a main electrical contact and a ground contact, said main electrical contact being electrically connected to said inner tubular member through one of said longitudinal slots in said outer tubular member, and said ground contact being electrically connected to said outer tubular member, said electrical conductor being selectively adjustable along the longitudinal length of said longitudinal slot in said outer tubular member.

2. An antenna assembly for use on a vehicle as in claim 1 further comprising:

electrical motor means operatively connected to the antenna to selectively extend or collapse said telescoping radiating sections of the antenna, said electrical motor means selectively controllable by a user.

3. An antenna assembly for use on a vehicle as in claim 1 including:

transmission line means for connection between the antenna assembly and a radio communications unit, said transmission line means having an impedance orders of magnitude less than the impedance of the antenna at the base end thereof.

4. An antenna assembly for use on a vehicle as in claim 1 wherein:

the impedance of said impedance matching means at said transmission line connection means is approximately 50 ohms to match the impedance of the transmission line means to be connected thereto, and the impedance of the antenna at the base end of the antenna is in excess of 50 ohms.

5. An antenna assembly for use on a vehicle as in claim 1 wherein said inner tubular member of said impedance matching means is substantially-one-quarter wavelength in length at the frequencies of interest.

6. An antenna assembly for use on a vehicle, comprising:

a first elongated radiating section;

a second collinear, tubular elongated radiating section electrically connected through a phasing coil to said first section;

said first and second radiating sections being in telescoping relation to one another;

an insulated mounting base, adapted to receive said telescoped first and second sections so that said first and second radiating sections can be selectively telescoped to an extended position for transmitting or receiving signals and telescopically collapsed toward said base to a closed position when the antenna is not in use;

impedance matching means having capacitively coupled concentric outer and inner conductive tubular members with sufficient length and inner diameter to slidably receive therein said telescopically collapsed first and second radiating sections, both of said tubular members attached to said mounting base and held spaced from one another in a fixed, electrically insulated relation, said inner tubular member electrically connected to the antenna at a base end thereof, said outer tubular member having at least one aperture therein, said impedance matching means displaying an impedance which varies between a first impedance at said connection to the antenna base end which is substantially equal to the impedance of the antenna base end, and a second impedance at least several orders of magnitude less than said first impedance; and means for connecting transmission line means to said impedance matching means at a point where the impedance of said impedance matching means is substantially equal to the impedance of said transmission line means including an electrical conductor having a main electrical contact and a ground contact, said main electrical contact being electrically connected to said inner tubular member through said aperture in said outer tubular member, and said ground contact electrically connected to said outer tubular member, said electrical conductor being selectively adjustable along the longitudinal length of said outer tubular member via said aperture.

7. An antenna assembly for use on a vehicle as in claim 6 further comprising:

electrical motor means operatively connected to the antenna to selectively extend or collapse said telescoping radiating sections of the antenna, said electrical motor means selectively controllable by a user.

8. An antenna assembly for use on a vehicle as in claim 6 wherein said first elongated radiating section of the antenna is voltage fed.

9. An antenna assembly for use on a vehicle as in claim 8 wherein said voltage fed first elongated radiating section of the antenna is substantially an integral multiple of a half wavelength for the frequency band for which the antenna is intended.

10. An antenna assembly for use on a vehicle as in claim 6 wherein said first elongated radiating section of the antenna is current fed.

11. An antenna assembly for use on a vehicle as in claim 10 wherein said current fed first elongated radiating section of the antenna is substantially an odd integral multiple of a quarter wavelength for the frequency band for which the antenna is intended.

12. An antenna assembly for use on a vehicle as in claim 6 including:

transmission line means for connection between the antenna assembly and a radio communications unit, said transmission line means having an impedance orders of magnitude less than the impedance of the antenna at the base end thereof.

13. An antenna assembly for use on a vehicle as in claim 6 wherein:

the impedance of said impedance matching means at said transmission line connection means is approximately 50 ohms to match the impedance of the transmission line means to be connected thereto, and the impedance of the antenna at the base end of the antenna is substantially in excess of 50 ohms.

14. An antenna assembly for use on a vehicle as in claim 6 wherein said inner tubular member of said impedance matching means is substantially one-quarter wavelength in length at the frequencies of interest.

15. An antenna assembly for use on a vehicle as in claim 6 wherein said at least one aperture includes at least one longitudinal slot in the walls of said outer tubular member.

16. An antenna assembly for use on a vehicle as in claim 6 further including a second aperture, said aperture comprising two longitudinal slots aligned on opposite sides of the wall of said outer tubular member.

17. An antenna assembly for use on a vehicle, comprising:

an elongated radiating section in telescoping relation to an insulated mounting base adapted to telescopically receive said elongated section, so that said radiating section is capable of being selectively telescoped to an extended position for transmitting or receiving signals and collapsed toward said base to a closed position when the antenna is not in use;

impedance matching means having capacitively coupled concentric outer and inner conductive tubular members with sufficient length and inner diameter to slidably receive therein said telescopically collapsed elongated radiating section, both of said tubular members attached to said mounting base and held spaced from one another in a fixed, electrically insulated relation, said inner tubular member being electrically connected to said radiating section at a base end thereof, said outer tubular member having at least one aperture therein, said impedance matching means displaying an impedance which varies between a first impedance at said connection to said radiating section base end which is substantially equal to the impedance of said radiating section base end, and a second impedance at least several orders of magnitude less than said first impedance; and coupling means adapted to connect transmission line means to said impedance matching means at a point where the impedance of said impedance matching means is substantially equal to the impedance of said transmission line means, said coupling means including a longitudinally adjustable electrical conductor having a main electrical contact and a ground contact, said main electrical contact being electrically connected to said inner tubular member through said aperture in said outer tubular member, and said ground contact electrically connected to said outer tubular member, said electrical conductor being selectively adjustable along the longitudinal length of said outer tubular member for selecting an impedance appropriate for the transfer of an electrical signal.

18. An antenna assembly for use on a vehicle as in claim 17 further comprising:

electrical motor means operatively connected to the antenna to selectively extend or collapse said telescoping radiating section of the antenna, said electrical motor means selectively controllable by a user.

19. An antenna assembly for use on a vehicle as in claim 17 wherein said elongated radiating section of the antenna is voltage fed.

20. An antenna assembly for use on a vehicle as in claim 19 wherein said voltage fed elongated radiating section of the antenna is substantially an integral multiple of a half wavelength for the frequency band of interest.

21. An antenna assembly for use on a vehicle as in claim 17 wherein said elongated radiating section of the antenna is current fed.

22. An antenna assembly for use on a vehicle as in claim 21 wherein said current fed elongated radiating section of the antenna is substantially an odd integral multiple of a quarter wavelength for the frequency band of interest.

23. An antenna assembly for use on a vehicle as in claim 17 including:

transmission line means for connection between the antenna assembly and a radio communications unit, said transmission line means having an impedance that is orders of magnitude less than the impedance of the antenna at the base end thereof.

24. An antenna assembly for use on a vehicle as in claim 17 wherein:

the impedance of said impedance matching means at said transmission line connection means is approximately 50 ohms to match the impedance of the transmission line means to be connected thereto, and the impedance of the antenna at the base end of the antenna is in excess of 50 ohms.

25. An antenna assembly for use on a vehicle as in claim 17 wherein said inner tubular member of said impedance matching means is substantially one-quarter wavelength in length for the frequency band of interest.

26. An antenna assembly for use on a vehicle as in claim 17 wherein said at least on aperture includes at least one longitudinal slot in the walls of said outer tubular member.

27. An antenna assembly for use on a vehicle as in claim 17 further including a second aperture, said first and second apertures comprising two longitudinal slots aligned on opposite sides of the wall of said outer tubular member.

* * * * *